US010394158B2

(12) United States Patent
Nagashima

(10) Patent No.: US 10,394,158 B2
(45) Date of Patent: Aug. 27, 2019

(54) IMAGE FORMING APPARATUS INCLUDING PHOTOSENSITIVE DRUM EXPOSED BY EXPOSURE DEVICE

(71) Applicant: KYOCERA Document Solutions Inc., Osaka (JP)

(72) Inventor: Teruhiko Nagashima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/118,106

(22) Filed: Aug. 30, 2018

(65) Prior Publication Data

US 2019/0094746 A1 Mar. 28, 2019

(30) Foreign Application Priority Data

Sep. 22, 2017 (JP) ..... 2017-182721
Sep. 22, 2017 (JP) ..... 2017-182722

(51) Int. Cl.
*G03G 15/04* (2006.01)
*G03G 21/16* (2006.01)

(52) U.S. Cl.
CPC . *G03G 15/04036* (2013.01); *G03G 15/04072* (2013.01); *G03G 21/1666* (2013.01); *G03G 2221/1654* (2013.01)

(58) Field of Classification Search
CPC ..... G03G 15/04036; G03G 2215/0158; G03G 15/751; G03G 21/1671; G03G 15/043
See application file for complete search history.

(56) References Cited

U.S. PATENT DOCUMENTS 4,816,844 A * 3/1989 Uchida ..... G06K 15/1295 346/145
5,072,244 A * 12/1991 Aoki ..... H04N 1/047 347/116
9,341,991 B1 5/2016 Horrall et al.

FOREIGN PATENT DOCUMENTS

JP H04-250474 A 9/1992
JP H08-146317 A 6/1996
JP 2000-098685 A 4/2000
JP 2007-334080 A 12/2007

OTHER PUBLICATIONS

Extended European Search Report issued by the European Patent Office dated Dec. 5, 2018, which corresponds to EP18188619.3-1022 and is related to U.S. Appl. No. 16/118,106.

* cited by examiner

*Primary Examiner* — Sandra Brase
(74) *Attorney, Agent, or Firm* — Studebaker & Brackett PC

(57) ABSTRACT

An image forming apparatus includes a groove, an exposure device and an adjustment member. In the groove, a rotation shaft of a photosensitive drum is inserted. The exposure device is configured to emit a laser light on the photosensitive drum to form an electrostatic latent image. The adjustment member is configured to shift the rotation shaft vertically in the groove to adjust a skew of the laser light.

10 Claims, 14 Drawing Sheets

IMAGE FORMING APPARATUS INCLUDING PHOTOSENSITIVE DRUM EXPOSED BY EXPOSURE DEVICE

INCORPORATION BY REFERENCE

This application is based on and claims the benefit of priorities from Japanese Patent application No. 2017-182722 filed on Sep. 22, 2017 and Japanese Patent application No. 2017-182721 filed on Sep. 22, 2017, which are incorporated by reference in their entirety.

BACKGROUND

The present disclosure relates to an image forming apparatus provided with a photosensitive drum on which an electrostatic latent image is formed.

In an electrophotographic type image forming apparatus, a photosensitive drum is exposed with laser light emitted from an optical element of an exposure device to form an electrostatic latent image on the photosensitive drum. If the exposure device is slightly displaced from the photosensitive drum, a skew (a distortion) occurs on the image (the electrostatic latent image) on the photosensitive drum. This causes a color shift. Because plural elements are conventionally arranged between the optical element and the photosensitive drum, it is difficult to position the optical elements and the photosensitive drum with a high precision.

For example, the image forming apparatus is sometimes provided with an exposure device arranged obliquely with respect to a rotation shaft of the photosensitive drum. In the image forming apparatus, a rotation speed of the photosensitive drum is finely adjusted such that an inclination of the toner image is the same as the inclination of the exposure device. Alternatively, another image forming apparatus is provided with an exposure device in which a mirror is finely adjusted by using a stepping motor.

However, in a case where the element of the exposure device is finely adjusted, the structure and the control process of the exposure device may be complicated and the exposure device may be made large in size.

SUMMARY

In accordance with an aspect of the present disclosure, an image forming apparatus includes a groove, an exposure device and an adjustment member. In the groove, a rotation shaft of a photosensitive drum is inserted. The exposure device is configured to emit a laser light on the photosensitive drum to form an electrostatic latent image. The adjustment member is configured to shift the rotation shaft vertically in the groove to adjust a skew of the laser light.

The above and other objects, features, and advantages of the present disclosure will become more apparent from the following description when taken in conjunction with the accompanying drawings in which a preferred embodiment of the present disclosure is shown byway of illustrative example.

DETAILED DESCRIPTION

Hereinafter, with reference to the attached drawings, an image forming apparatus according to one embodiment of the present disclosure will be described.

Figure 1:
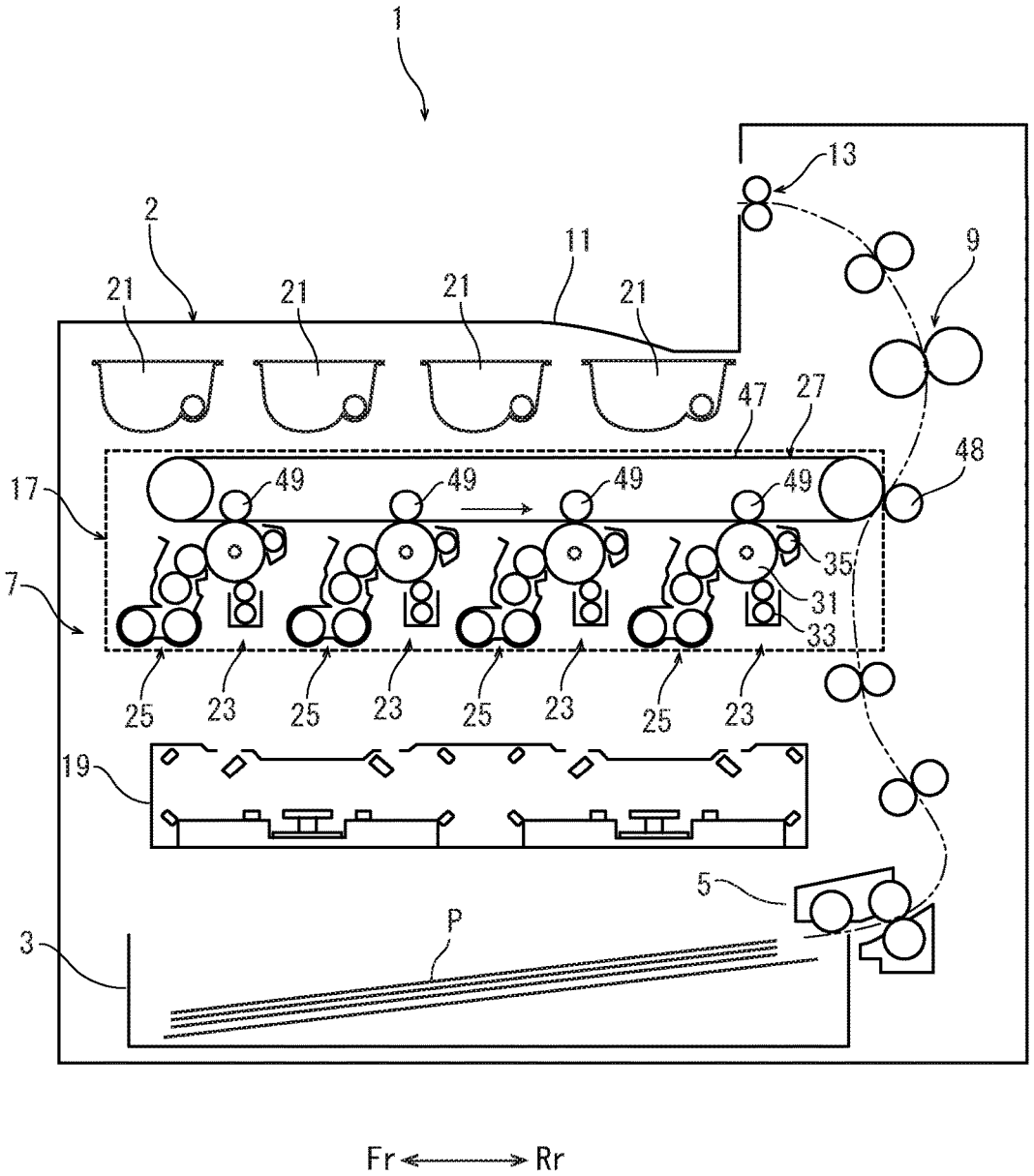
FIG. 1 is a sectional view schematically showing an inner structure of a color printer according to one embodiment of the present disclosure.

First, with reference to FIG. 1, an entire structure of a color printer 1 as the image forming apparatus will be described. FIG. 1 is a front view schematically showing an inner structure of the color printer. In the following description, a left side of a paper surface of FIG. 1 is defined to be a front side of the color printer. In each figure, Fr, Rr, L and R respectively indicate a front side, a rear side, a left side and a right side of the color printer 1.

An apparatus main body 2 of the color printer 1 includes a sheet feeding cassette 3 storing a sheet P, a sheet feeding device 5 feeding the sheet P from the sheet feeding cassette 3, an image forming part 7 forming a full color toner image on the sheet P, a fixing device 9 fixing the toner image on the sheet P, and a sheet ejecting device 13 ejecting the sheet P, having a fixed toner image, on an ejected sheet tray 11. In the apparatus main body 2, a conveying path for the sheet P is formed from the sheet feeding device 5 to the sheet ejecting device 13 through the image forming part 7 and the fixing device 9.

The image forming part 7 is provided with an image forming unit 17, an exposure device 19 arranged below the image forming unit 17 and four toner containers 21 arranged above the image forming unit 17.

Figure 2:
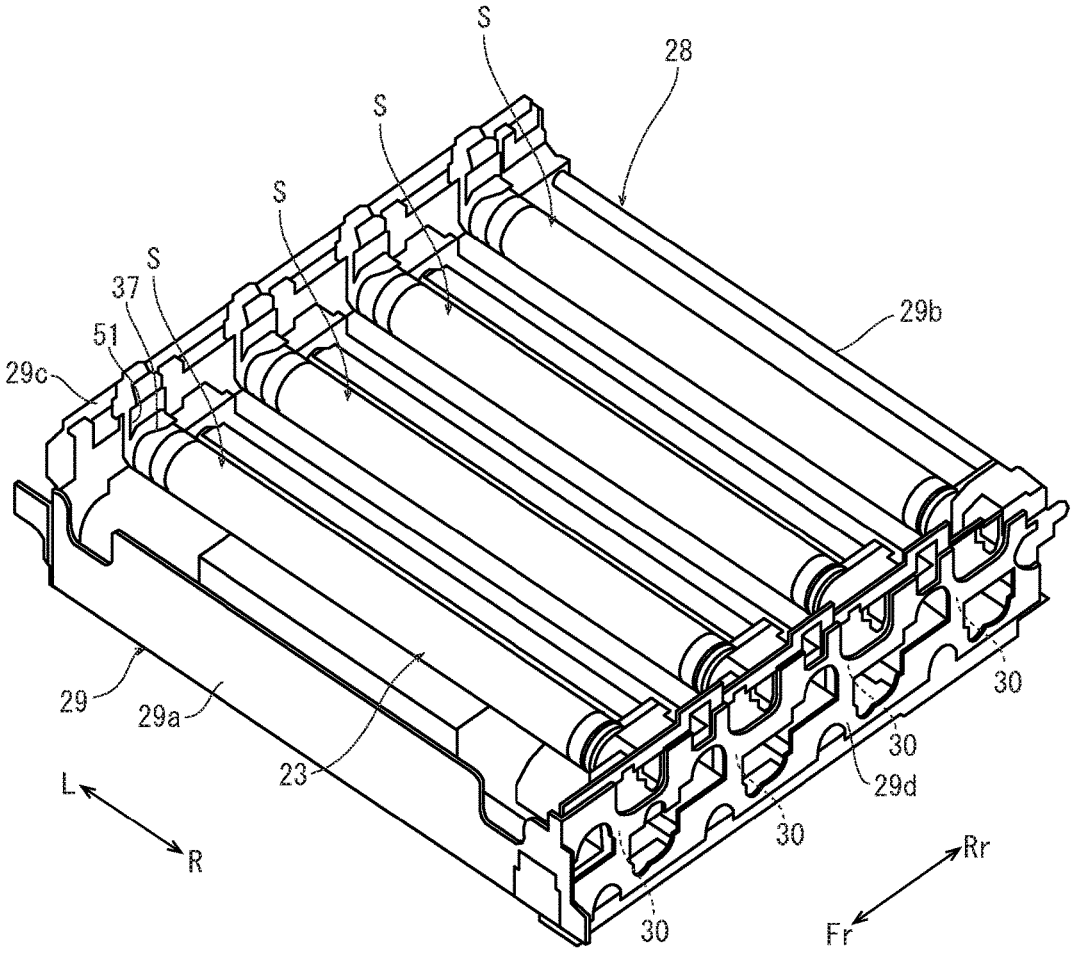
FIG. 2 is a perspective view showing an image forming frame to which a drum unit is attached, in the color printer according to the embodiment of the present disclosure.

Next, with reference to FIG. 1 and FIG. 2, the image forming unit 17 will be described. FIG. 2 is a perspective view showing an image forming frame to which a drum unit is attached.

The image forming unit 17 includes four drum units 23, four development units 25 (not shown in FIG. 2), an intermediate transferring unit 27 (refer to FIG. 1) and an image forming frame 28 (refer to FIG. 2) to which the drum units 23, the development units 25 and the intermediate transferring unit 27 are supported. The four drum units 23 and the four development units 25 respectively correspond to four colors (yellow, magenta, cyan and black) of the toner (the developer).

Figure 3:
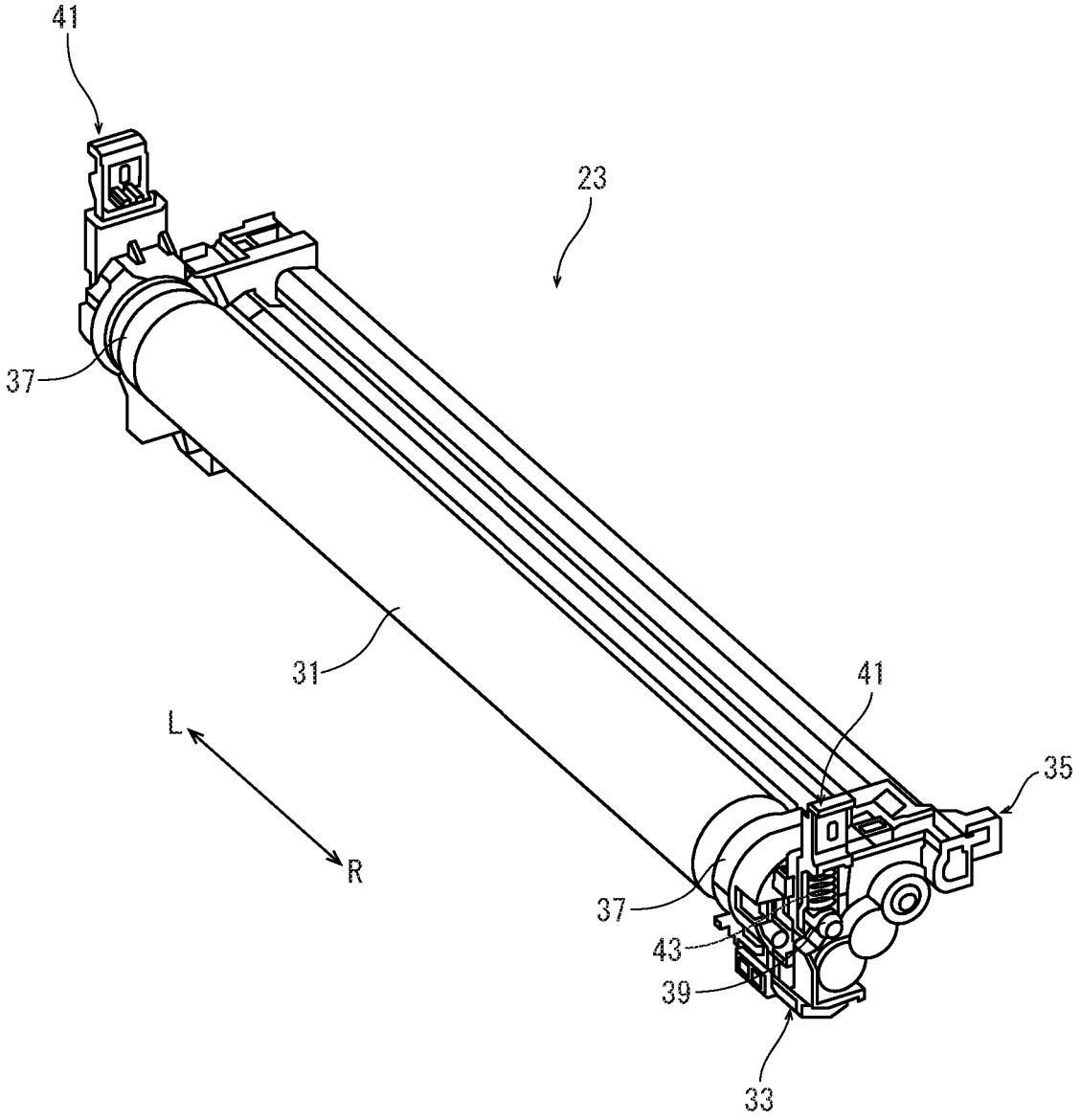
FIG. 3 is a perspective view showing the drum unit, in the color printer according to the embodiment of the present disclosure.

First, with reference to FIG. 3, the drum unit 23 will be described. FIG. 3 is a perspective view showing the drum unit 23.

The drum unit 23 includes a photosensitive drum 31 on which an electrostatic latent image is formed. To both end openings of the photosensitive drum 31, flange members 37 are fixed. Between the flange members 37, a rotation shaft 39 is penetrated along an axial center of the photosensitive drum 31. The photosensitive drum 31 rotates in a predetermined direction (a clockwise direction in FIG. 1) around the rotation shaft 39. The left flange member 37 and a right end portion of the rotation shaft 39 are each inserted in a pressing lever 41. Between the left flange member 37 and the pressing lever 41, and between the right end portion of the rotation shaft 39 and the pressing lever 41, springs 43 are interposed respectively. The spring 43 is a biasing member which biases each of the left flange member 37 and the right end portion of the rotation shaft 39 downward.

The drum unit 23 further includes a charge device 33 charging the photosensitive drum 31 and a cleaning device removing the toner remained on the surface of the photosensitive drum 31. The charge device 33 and the cleaning device 35 are arranged along the rotation direction of the photosensitive drum 31.

The development unit 25 develops the electrostatic latent image formed on the surface of the photosensitive drum 31 and forms a toner image on the surface of the photosensitive drum 31.

The intermediate transferring unit 27 includes an endless intermediate transferring belt 47 and four primary transferring rollers 49, as shown in FIG. 1. The intermediate transferring belt 47 is bridged between a driven roller and a drive roller which are spaced each other in the front-and-rear direction, and circulates in a predetermined direction (the counterclockwise direction in FIG. 1). The four primary transferring rollers 49 are disposed in a hollow space of the intermediate transferring belt 47 at intervals in the front-and-rear direction, and faces an inner face of the intermediate transferring belt 47 at a lower circulation track. The intermediate transferring unit 27 transfers the toner image formed on the surface of the photosensitive drum 31 to the intermediate transferring belt 47 by the primary transferring rollers 49.

Next, the image forming frame 28 will be described with reference to FIG. 2 again. The image forming frame 28 includes a rectangular cylindrical main frame 29 and adjustment mechanisms 30 provided on the main frame 29 corresponding to the four drum units 23. The adjustment mechanism 30 corrects a skew of the electrostatic latent image formed on the photosensitive drum 31 by the exposure device 19, as described later.

The main frame 29 includes a front side plate 29*a* and a rear side plate 29*b* which face each other in the front-and-rear direction and a left side plate 29*c* and a right side plate 29*d* which face each other in the left-and-right direction. Between the left side plate 29*c* and the right side plate 29*d*, four attachment sections S to which the drum units 23 and the development units 25 are attached are formed in parallel along the front-and-rear direction. The four attachment sections S correspond to yellow, magenta, cyan and black in the order from the front side to the rear side of the main frame 29.

In each attachment section S of the left side plate 29*c*, a flange receiving groove 51 is formed. The flange receiving groove 51 is cut out from an upper edge of the left side plate 29*c* downward.

Figure 4:
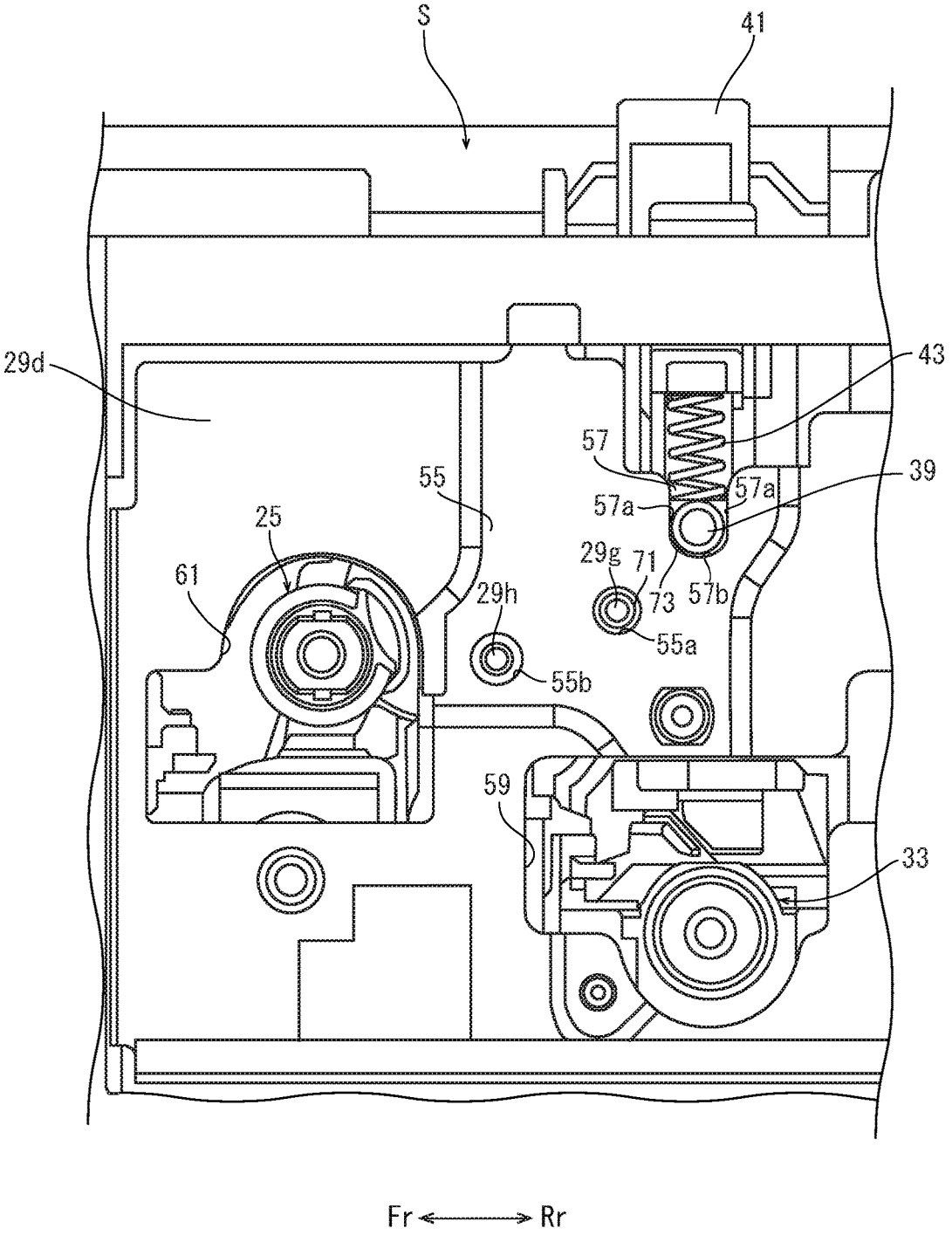
FIG. 4 is a front view showing an attachment section of a right side plate, in the color printer according to the embodiment of the present disclosure.
Figure 5:
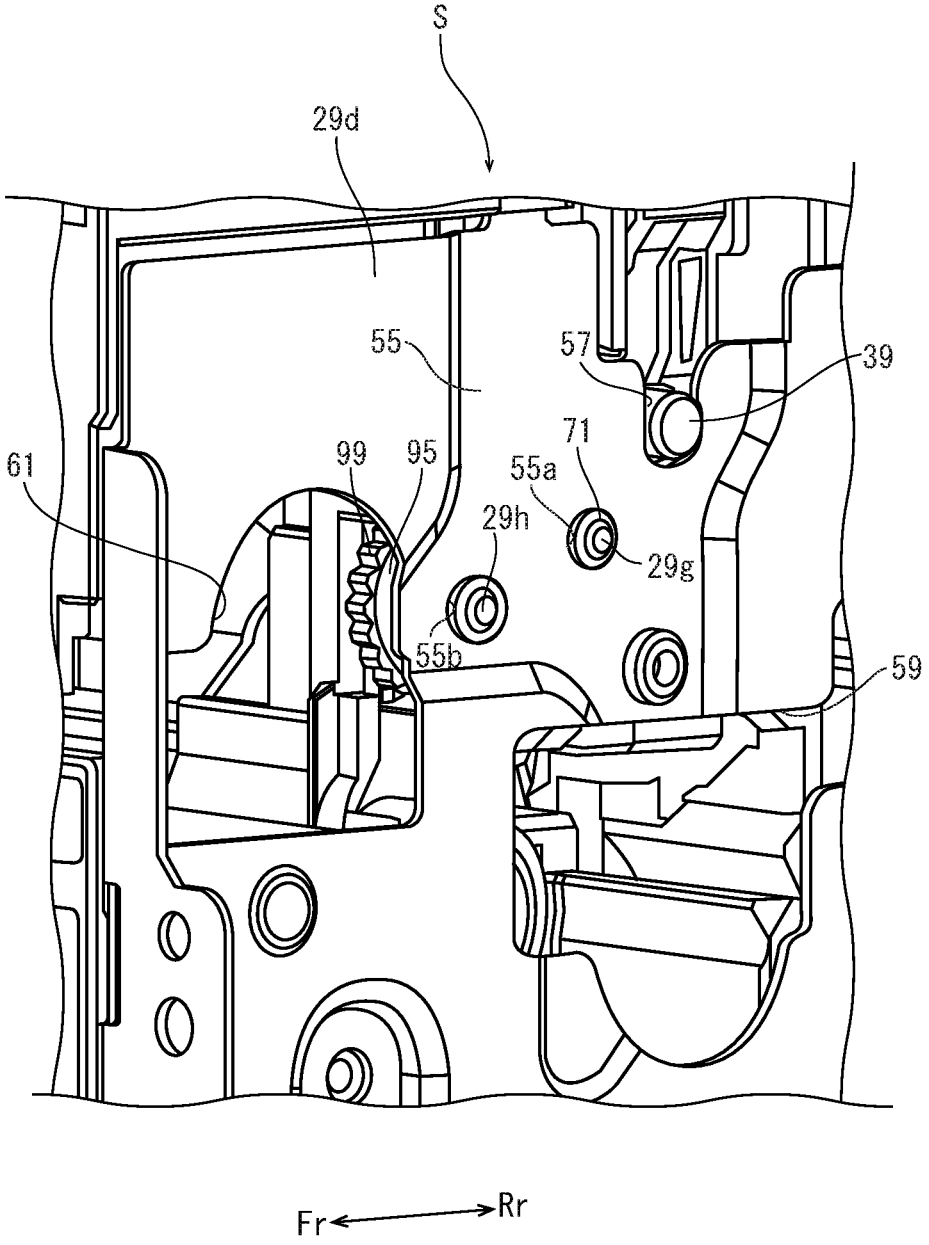
FIG. 5 is a perspective view showing the attachment section of the right side plate, in the color printer according to the embodiment of the present disclosure.

Each attachment section S of the right side plate 29*d* will be described with reference to FIG. 4 and FIG. 5. FIG. 4 is a front view showing the attachment section and FIG. 5 is a perspective view showing the attachment section.

In each attachment section S, a hollow portion 55 recessed from an outside to an inside is formed. In the hollow portion 55, a shaft receiving groove 57 is formed. The shaft receiving groove 57 is cut out from an upper edge of the right side plate 29*d* downward. A width of the shaft receiving groove 57 is slightly wider than a diameter of the rotation shaft 39 of the photosensitive drum 31. As shown in FIG. 4, the shaft receiving groove 57 has front and rear side vertical edges 57*a* and a bottom edge 57*b* curved downward in an arc-shape.

In each attachment section S, a lower opening 59 and a side opening 61 are formed at a lower side and an oblique front lower side of the hollow portion 55 respectively. The both openings 59 and 61 are communicated with the hollow portion 55. In the hollow portion 55, a first through hole 55*a* and a second through hole 55*b* are formed between the shaft receiving groove 57 and the side opening 61.

The drum unit 23 is attached to the attachment section S such that the left flange member 37 of the photosensitive drum 31 is inserted in the flange receiving groove 51 (refer to FIG. 2) of the left side plate 29*c* and the right end portion of the rotation shaft 39 of the photosensitive drum 31 is inserted in the shaft receiving groove 57 (refer to FIG. 4 and FIG. 5) of the right side plate 29*d*. The left and right pressing levers 41 are respectively engaged with the left side plate 29*c* and the right side plate 29*d*. Then, the left flange member 37 of the photosensitive drum 31 and the right end portion of the rotation shaft 39 of the photosensitive drum 31 are biased downward by the springs 43 to be positioned to the flange receiving groove 51 and the shaft receiving groove 57 respectively. As shown in FIG. 4, the charge device 33 is exposed through the lower opening 59 of the right side plate 29*d*.

The development unit 25 is attached to the attachment section S so as to face the photosensitive drum 31 at a downstream side of the charge device 33 in the rotation direction (the clockwise direction in FIG. 1) of the photosensitive drum 31. As shown in FIG. 4, the development unit 25 is exposed through the side opening 61 of the right side plate 29*d*.

The intermediate transferring unit 27 is attached to the main frame 29 above the four drum units 23 and the four development units 25 which are attached to the attachment sections S. Then, the primary transferring rollers 49 faces the photosensitive drum 31 via the intermediate transferring belt 47.

With reference to FIG. 1 again, the apparatus main body 2 is provided with a secondary transferring roller 48 at a downstream side of the image forming unit 17 in the circulation direction of the intermediate transferring belt 47. The secondary transferring roller 48 faces the intermediate transferring belt 47.

The exposure device 19 emits laser light toward the photosensitive drum 31 of each drum unit 23 to form the electrostatic latent image on the photosensitive drum 31. As shown in a left figure of FIG. 13, an angle of incidence of the laser light L on the surface of the photosensitive drum 31 is zero, as described later in detail. An irradiation angle φ of the laser light L with respect to a vertical line V passing through a center of the photosensitive drum 31 is about 10 degrees.

The four toner containers 21 store respectively the toner of four colors (yellow, magenta, cyan and black). The toner is supplied from the toner container 21 to the corresponding development unit 25.

Next, an image forming operation will be described. In the image forming part 7, the photosensitive drum 31 of each drum unit 23 is charged by the charge device 33 and then exposed by the exposure device 19 according to an image data to form the electrostatic latent image on the photosensitive drum 31. The electrostatic latent image is developed to the toner image by each development unit 25. Each toner image is transferred from the photosensitive drum 31 to the intermediate transferring belt 47 by the primary transferring roller 49 of the intermediate transferring unit 27. Thereby, a full color toner image is formed on the intermediate transferring belt 47. The full color toner image is transferred from the intermediate transferring belt 47 to the sheet P by the secondary transferring roller 48. The toner remained on the photosensitive drum 31 is removed by the cleaning device 35 of the drum unit 23. The sheet P on which the full color toner image is transferred is conveyed to the fixing device 9. The fixing device 9 fixes the full color toner image on the sheet P. The sheet P on which the full color toner image is fixed is ejected to the ejected sheet tray 11 by the sheet ejecting device 13.

Figure 6:
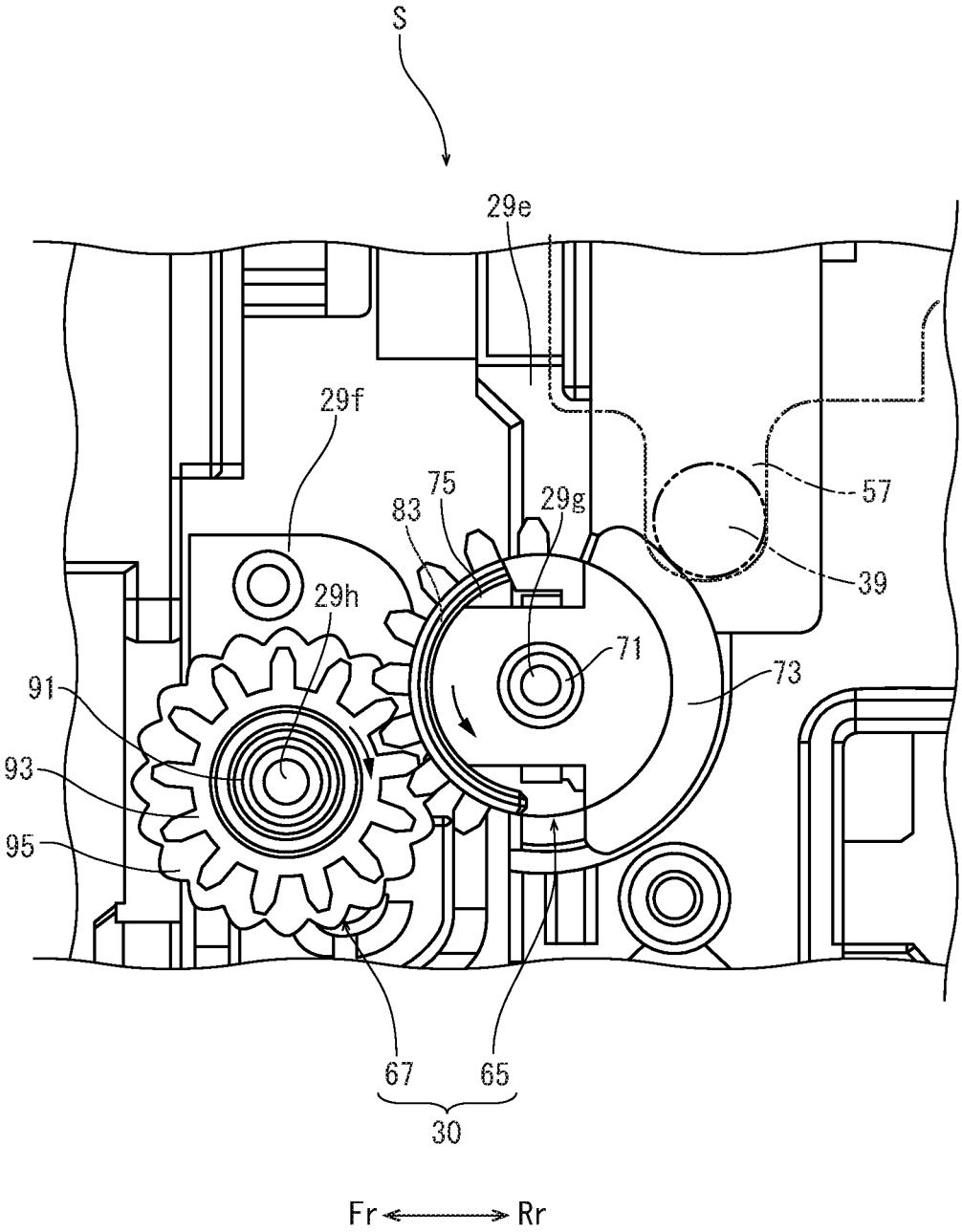
FIG. 6 is a front view showing an adjustment mechanism, in the color printer according to the embodiment of the present disclosure.
Figure 7:
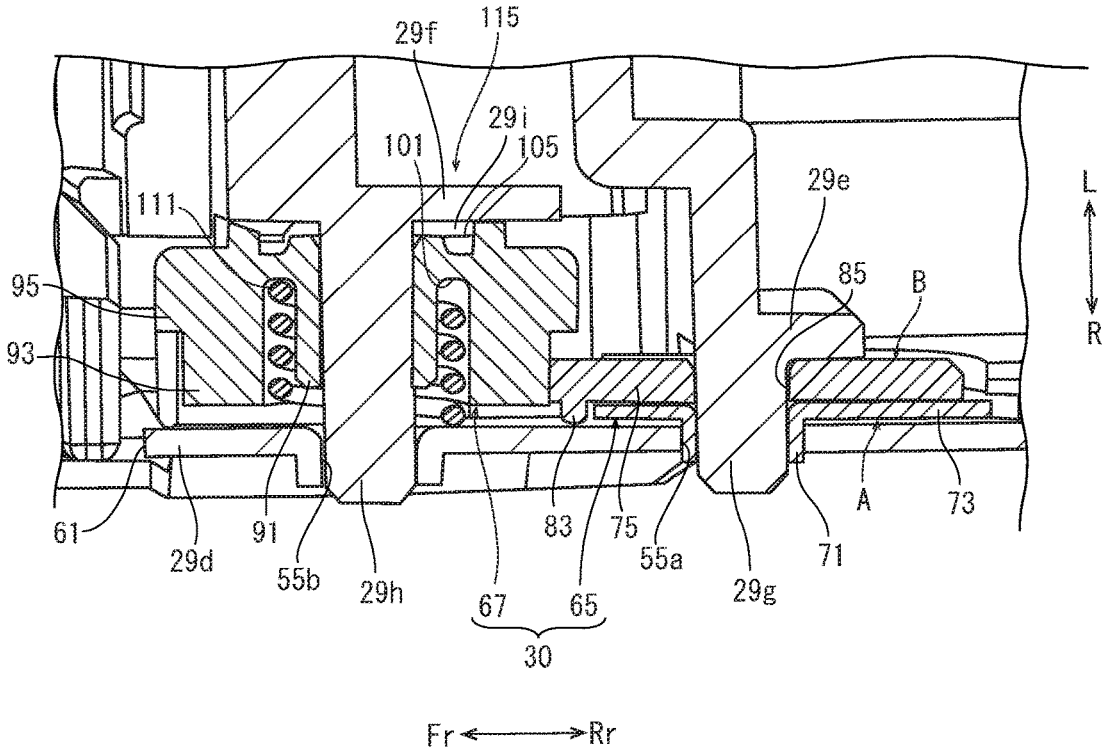
FIG. 7 is a sectional view showing the adjustment mechanism, in the color printer according to the embodiment of the present disclosure.
Figure 8:
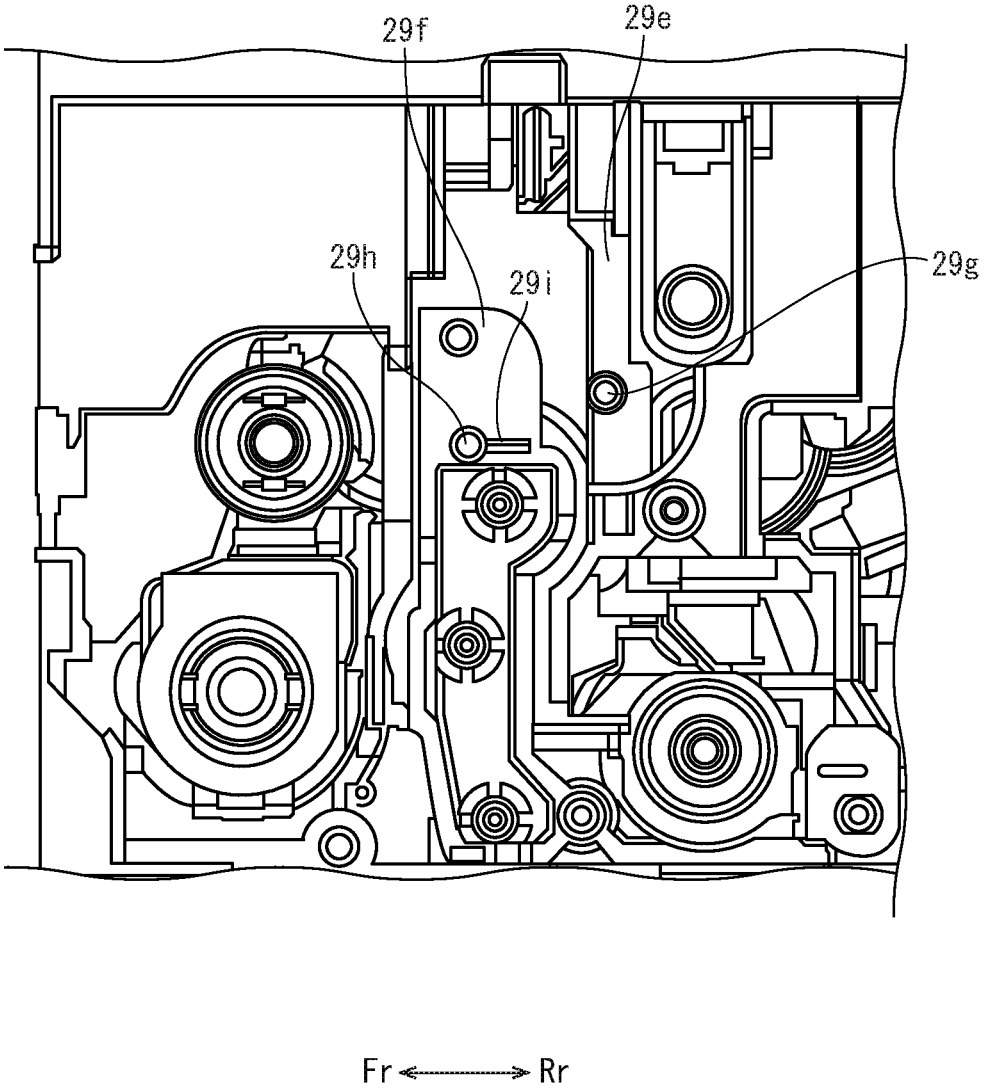
FIG. 8 is a front view showing a first inner plate and a second inner plate, in the color printer according to the embodiment of the present disclosure.

Next, the adjustment mechanism 30 will be described with reference to FIG. 6 to FIG. 8 in addition to FIG. 4 and FIG. 5. FIG. 6 is a front view showing the adjustment mechanism, FIG. 7 is a sectional view showing the adjustment mechanism and FIG. 8 is a front view showing a first inner plate and a second inner plate.

The adjustment mechanism 30 corrects the skew of the electrostatic latent image formed on the photosensitive drum 31 by the exposure device 19, as described above. The adjustment mechanism 30 includes an adjustment plate 65 and a dial gear 67 as shown in FIG. 6 and FIG. 7. The adjustment plate 65 is an adjustment member shifting the right end portion of the rotation shaft 39 of the photosensitive drum 31 in the shaft receiving groove 57. The dial gear 67 is a dial rotating the adjustment plate 65.

The adjustment plate 65 is supported in a rotatable manner between the right side plate 29*d* of the main frame 29 and a first inner plate 29*e* disposed inside the right side plate 29*d*. The dial gear 67 is supported in a rotatable manner between the right side plate 29*d* of the main frame 29 and a second inner plate 29*f* disposed inside the right side plate 29*d*.

The first inner plate 29*e* is provided with a first shaft 29*g* protruding horizontally rightward. The first shaft 29*g* is inserted in the first through hole 55*a* of the right side plate 29*d* (refer to FIG. 4 to FIG. 7). The second inner plate 29*f* is provided with a second shaft 29*h* protruding horizontally rightward. The second shaft 29*h* is inserted in the second through hole 55*b* of the right side plate 29*d* (refer to FIG. 4 to FIG. 7). The second inner plate 29*f* is provided with a protrusion 29*i* extending horizontally from the second shaft 29*h* rearward (refer to FIG. 7 and FIG. 8).

Figure 9:
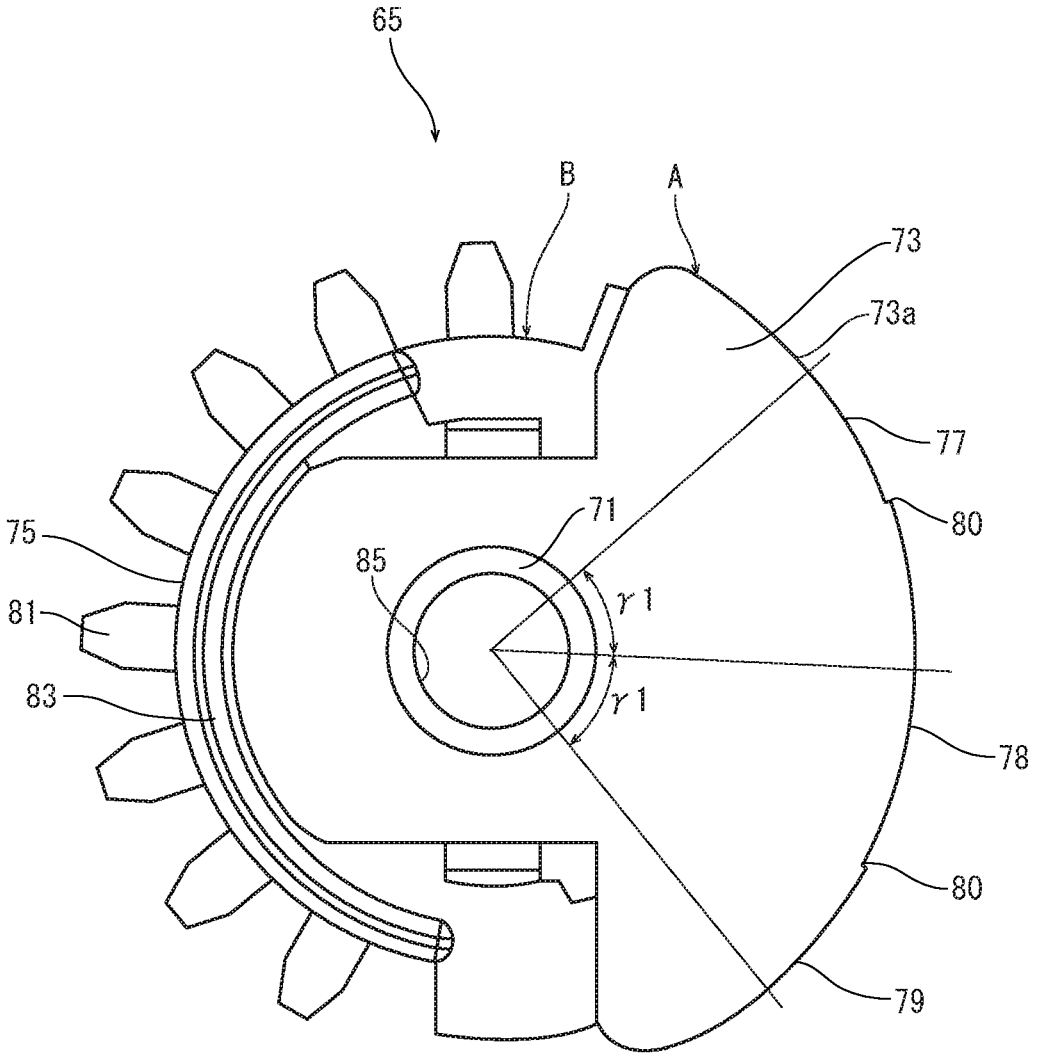
FIG. 9 is a front view showing an adjustment plate, in the color printer according to the embodiment of the present disclosure.

Next, the adjustment plate 65 will be described with reference to FIG. 9. FIG. 9 is a front view showing the adjustment plate.

The adjustment plate 65 is a disk-shaped member, and includes a cylindrical axial hole part 71, an approximately semicircular adjustment part 73 and an approximately semicircular gear part 75. The adjustment part 73 is provided at one side (the rear side) of the axial hole part 71 and the gear part 75 is provided at the other side (the front side) of the axial hole part 71. The adjustment part 73 has a circumferential edge 73*a* formed such that the radius (a distance between a center of the axial hole part 71 and the outer circumferential edge 73*a*) becomes large in a stepwise manner along the circumferential direction. In detail the outer circumferential edge 73*a* has a first arc-shaped edge 77, a second arc-shaped edge 78 and a third arc-shaped edge 79 in the order along the circumferential direction, and the radius becomes large in a stepwise manner in the order. For example, a difference in the radius between the adjacent disposed arc-shaped edges is 0.1 mm. The adjacent disposed arc-shaped edges are connected via a stepped portion 80 extending radially. The first to third arc-shaped edges 77, 78 and 79 have the same center angle. An angle between centers of the adjacent disposed the arc-shaped edges is set to be γ1. Along a circumferential edge of the gear part 75, gear teeth 81 are formed at predetermined intervals along the circumferential direction. The gear part 75 has an arc-shaped rib 83 along the circumferential direction. The rib 83 is formed in a semi-circular cross section.

The adjustment plate 65 is formed by preparing a member A formed with the axial hole part 71 and the adjustment part 73 integrally and a member B formed with the gear part 75 and an axial hole 85 integrally, overlapping them with aligning the axial hole part 71 and the axial hole 85 coaxially and then coupling them, as shown in FIG. 7 and FIG. 9. The member A is made of metal, and the member B is made of resin. However, the configuration of the adjustment plate 65 is not limited thereto.

As shown in FIG. 6 and FIG. 7, the adjustment plate 65 is supported by the first shaft 29*g* of the first inner plate 29*e* with the rib 83 facing the right side plate 29*d*. In detail, the first shaft 29*g* is inserted in the axial hole part 71 of the adjustment plate 65, and the axial hole part 71 is penetrated through the first hole 55*a*. The adjustment plate 65 is supported in a rotatable manner around the first shaft 29*g* and in a non-movable manner in an axis direction of the first shaft 29*g*. When the adjustment plate 65 is rotated, a tip end face of the rib 83 is slid with respect to an inner face of the right side plate 29*d*. As shown in FIG. 6, the adjustment part 73 is exposed to the shaft receiving groove 57 above the bottom edge 57*b* obliquely from the front lower side.

Figure 10:
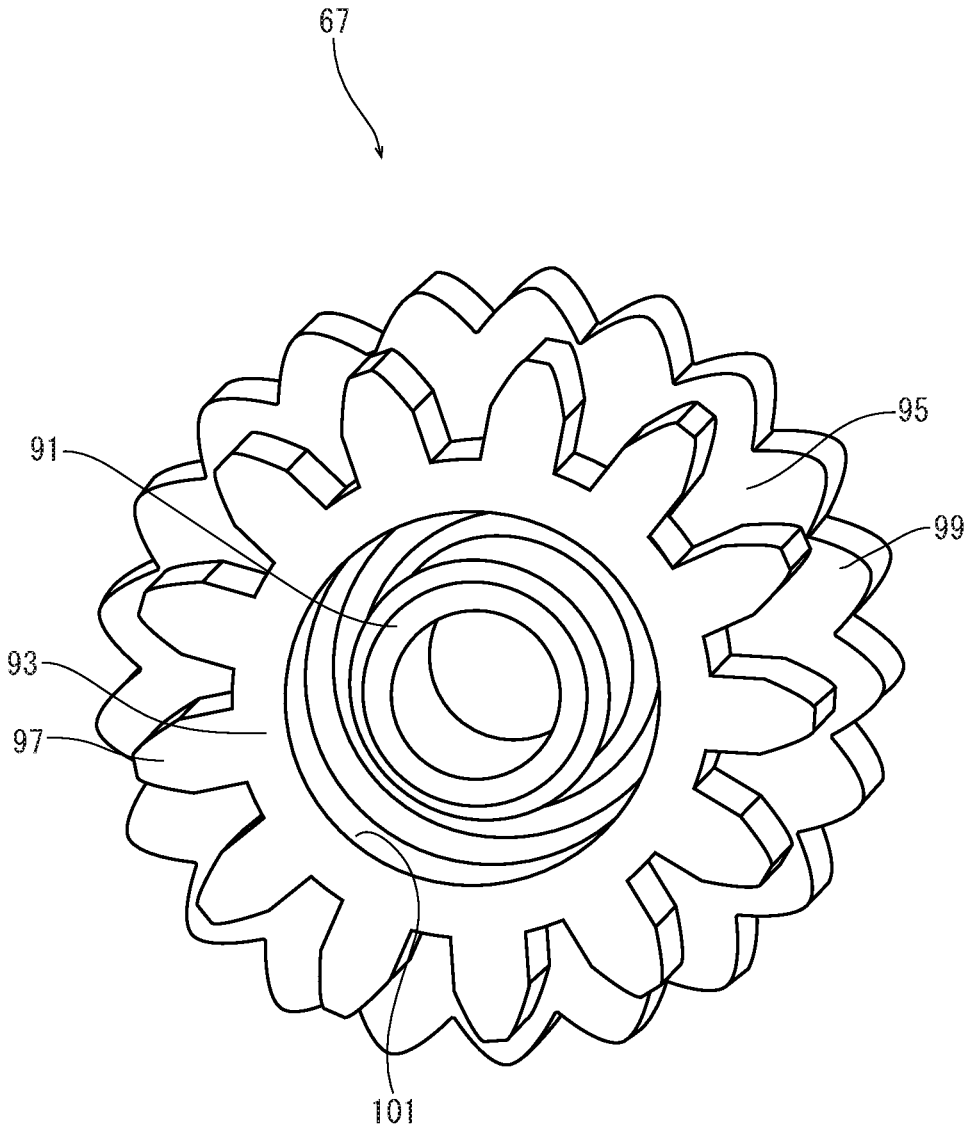
FIG. 10 is a perspective view showing a dial gear, in the color printer according to the embodiment of the present disclosure.
Figure 11A:
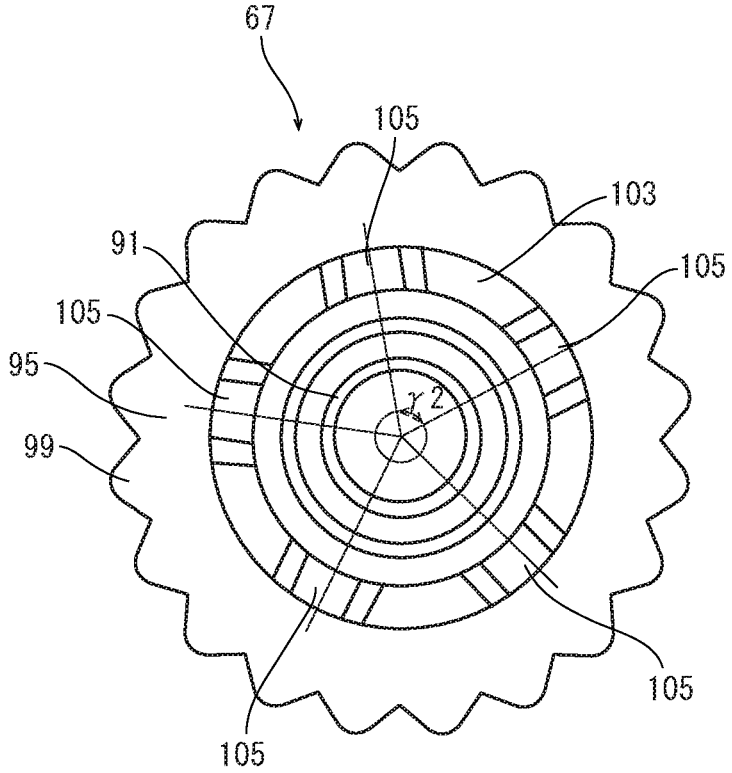
FIG. 11A is a back view showing the dial gear, in the color printer according to the embodiment of the present disclosure.
Figure 11B:
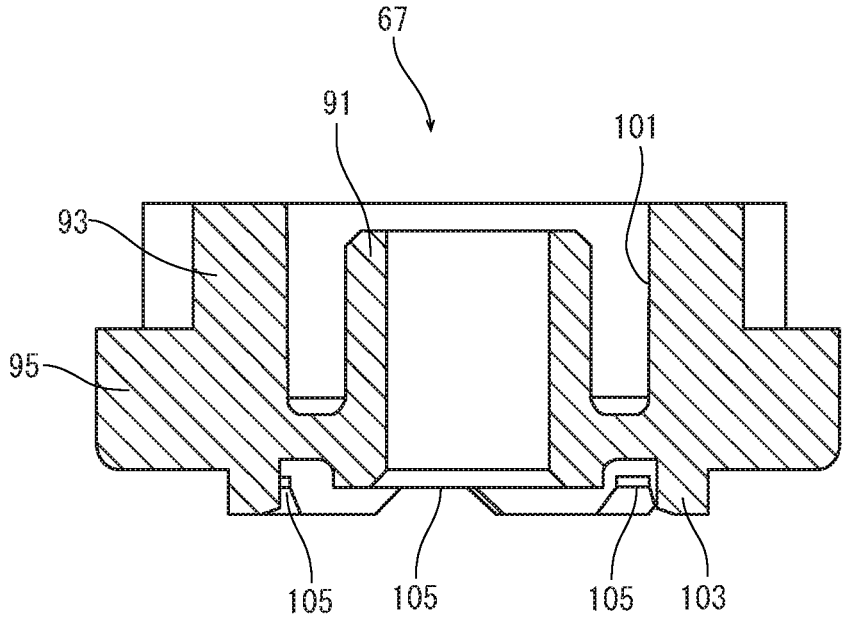
FIG. 11B is a sectional view showing the dial gear, in the color printer according to the embodiment of the present disclosure.

Next, the dial gear 67 will be described with reference to FIG. 10, FIG. 11A and FIG. 11B. FIG. 10 is a perspective view showing the dial gear, FIG. 11A is a back view showing the dial gear and FIG. 11B is a sectional view showing the dial gear.

The dial gear 67 is a disk-shaped member, and includes an axial hole part 91, a gear part 93 and a rack part 95 which are provided coaxially with the axial hole part 91. The rack part 95 has an outer diameter larger than that of the gear part 93. Along an outer circumferential edge of the gear part 93, gear teeth 97 engageable with the gear teeth 81 of the gear part 75 of the adjustment plate 65 are formed. Along an outer circumferential edge of the rack part 95, rack teeth 99 are formed at predetermined intervals.

On one face (a face at the side of the gear part 93) of the dial gear 67, an annular groove 101 is formed around the axial hole part 91. As shown in FIG. 11A and FIG. 11B, on the other face (a face at the side of the rack part 95) of the dial gear 67, an annular rib 103 is formed around the axial hole part 91. The rib 103 has plural (for example, five) recesses 105 along the circumferential direction at equal center angles. An angle between centers of the adjacent disposed recesses 105 is set to be γ2. Both side faces of each recess 105 are inclined outward in the circumferential direction.

As shown in FIG. 6 and FIG. 7, the axial hole part 91 of the dial gear 67 is inserted to the second shaft 29*h* of the second inner plate 29*f* with the gear part 93 facing the inner face of the right side plate 29*d*. The dial gear 67 is supported in a rotatable manner around the second shaft 29*h* and a movable manner along an axial direction of the second shaft 29*h*. The gear teeth 97 of the gear part 93 is meshed with the gear teeth 81 of the gear part 75 of the adjustment plate 65, and the adjustment plate 65 is engaged with the dial gear 67. Thereby, by rotating the dial gear 67, it becomes possible to rotate the adjustment plate 65. As shown in FIG. 5, the rack teeth 99 of the rack part 95 is exposed to the side opening 61 of the right side plate 29*d* when viewed obliquely from the front side.

As shown in FIG. 7, between the groove 101 of the dial gear 67 and the right side plate 29*d*, a spring 111 is arranged. The spring 111 biases the dial gear 67 to the second inner plate 29*f* along the axial direction of the second shaft 29*h*. Thereby, one of the plurality of recesses 105 (refer to FIG. 11A and FIG. 11B) of the rib 103 is engaged with the protrusion 29*i* of the second inner plate 29*f* to restrict the dial gear 67 from being rotated. As described, the plurality of recesses 105 of the dial gear 67, the protrusion 29*i* of the second inner plate 29*f* as a support member to which the dial gear 67 is supported and the spring 111 biasing the dial gear 67 to the second inner plate 29*f* constitute a lock mechanism 115 to restrict the dial gear 67 from being rotated.

On the other hand, when the dial gear 67 is rotated, one inclined side face of the recess 105 engaged with the protrusion 29*i* comes into contact with the protrusion 29*i*, the dial gear 67 is guided along the inclined side face in a direction away from the protrusion 29*i* against the biasing force of the spring 111, and then the rib 103 runs on the protrusion 29*i*. When the dial gear 67 is further rotated, the dial gear 67 is biased by the spring 111 in a direction close to the protrusion 29*i*, and then the adjacent disposed recess 105 is engaged with the protrusion 29*i*. At this time, a click feeling is offered on the dial gear 67.

Here, the angle γ1 between the adjacent disposed arc-shaped edges (refer to FIG. 9), the angle γ2 between the adjacent disposed recesses 105, a number of teeth Z1 of the gear part 93 of the dial gear 67 and a number of teeth Z2 of the gear part 75 of the adjustment plate 65 are set so as to satisfy the following relationship, $$\gamma 1=\gamma 2\times Z2/Z1.$$

By satisfying the above relationship, when the dial gear 67 is rotated until either one of the recesses 105 is engaged with the protrusion 29*i*, in the other words, when the dial gear 67 is rotated until the click feeling is felt, either one of the first to third arc-shaped edges 77, 78 and 79 is exposed to the shaft receiving groove 57.

Figure 12:
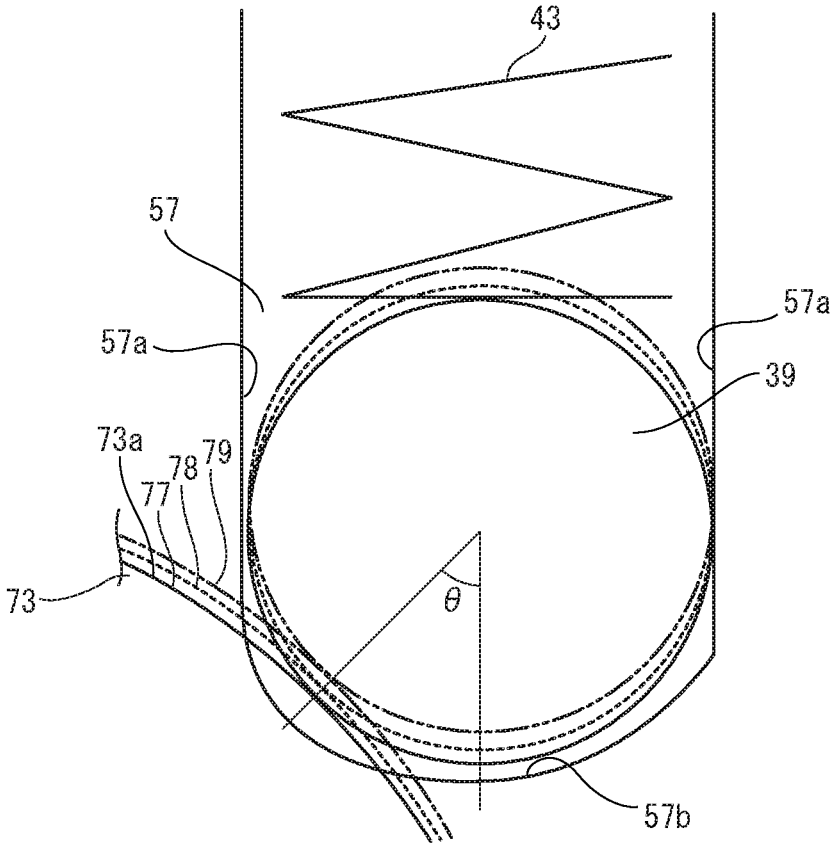
FIG. 12 is a front view explaining a displacement of a rotation shaft in a groove, in the color printer according to the embodiment of the present disclosure.

Next, an operation to shift the rotation shaft 39 of the photosensitive drum 31 vertically will be described with reference to FIG. 12 and the others. FIG. 12 is a front view showing the rotation shaft inserted in the groove.

As described above, the adjustment part 73 of the adjustment plate 65 is exposed to the shaft receiving groove 57 above the bottom edge 57*b* obliquely from the front lower side. For example, the center portion of the first arc-shaped edge 77 of the circumferential edge 73*a* of the adjustment part 73 is exposed to the shaft receiving groove 57. When the rotation shaft 39 is inserted in the shaft receiving groove 57, the first arc-shaped edge 77 of the adjustment part 73 comes into contact with the rotation shaft 39 and presses the rotation shaft 39 on the rear side edge 57*a* of the shaft receiving groove 57. Because the rotation shaft 39 is pressed downward by the spring 43, the rotation shaft 39 is positioned in the upper-and-lower direction and in the front-and-rear direction by the spring 43, the first arc-shaped edge 77 and the rear side edge 57*a*. For example, an angle θ of a line passing through a contact position of the outer circumferential edge 73*a* of the adjustment part 73 with the rotation shaft 39 and the axial center of the rotation shaft 39 with respect to a vertical line passing through the axial center of the rotation shaft 39 is 45 degrees.

As shown in FIG. 5, a finger is inserted through the side opening 61, catches the rack teeth 99 of the rack part 95 of the dial gear 67 and then rotates the dial gear 67 in the clockwise direction in FIG. 6 until the click feeling is felt. Then, the adjustment plate 65 is rotated in the counterclockwise direction in FIG. 6, and then, as shown by a broken line in FIG. 12, the second arc-shaped edge 78 comes into contact with the rotation shaft 39. Because the second arc-shaped edge 78 has a radius larger than that of the first arc-shaped edge 77, the rotation shaft 39 is pushed out outwardly in the radial direction of the adjustment plate 65 and then shifted upward along the side edge 57*a*. For example, an upward shift distance is 0.28 mm.

When the dial gear 67 is further rotated in the clockwise direction in FIG. 6 until the click feeling is felt, the adjustment plate 65 is further rotated in the counterclockwise direction in FIG. 6, and then, as shown by a two-dotted chain line in FIG. 12, the third arc-shaped edge 79 comes into contact with the rotation shaft 39. Because the third arc-shaped edge 79 has a radius larger than that of the second arc-shaped edge 78, the rotation shaft 39 is pushed out outwardly in the radial direction of the adjustment plate 65 and then shifted upward along the side edge 57*a*. Because a difference in the radius between the second and third arc-shaped edges 78 and 79 is equal to a difference in the radius between the first and second arc-shaped edges 77 and 78, the rotation shaft 39 is shifted upward by the same distance (for example, 0.28 mm) as the last time.

When the rotation shaft 39 is sifted downward, the dial gear 67 is rotated in the counterclockwise direction in FIG. 6. When the dial gear 67 is rotated until the click feeling is felt, the adjustment plate 65 is rotated in the clockwise direction in FIG. 6. Then, the second arc-shaped edge 78 comes into contact with the rotation shaft 39, and the rotation shaft 39 is shifted downward along the side edge 57*a*.

As described, when the dial gear 67 is operated to rotate the adjustment plate 65, the contact position of the outer circumferential edge 73*a* of the adjustment part 73 of the adjustment plate 65 with the rotation shaft 39 is varied. Then, depending on the radius of the adjustment part 73 at the contact position, the rotation shaft 39 is shifted upward or downward along the side edge 57*a* of the shaft receiving groove 57. Thereby, it becomes possible to shift the right end portion of the rotation shaft 39 upward and downward. In the embodiment, because the difference in the radius between the adjacent disposed arc-shaped edges is equal, it becomes possible to shift the right end portion of the rotation shaft 39 by the same distance.

Figure 13:
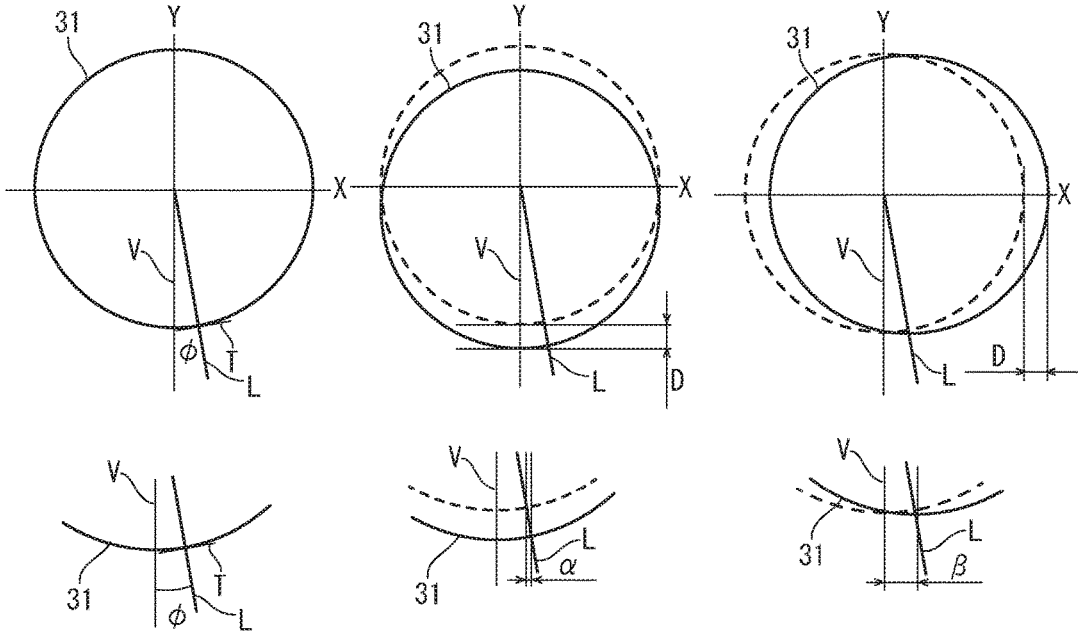
FIG. 13 is a view schematically explaining a writing position displacement of laser light, in the color printer according to the embodiment of the present disclosure.

Next, with reference to FIG. 13, an adjustment of the laser light emitted from the exposure device 19 will be described with reference to FIG. 13. FIG. 13 is views explaining a displacement of a writing position of the laser light in a case where the photosensitive drum 31 is shifted in a direction (a Y direction) along a vertical line V passing through the axial center of the photosensitive drum 31 (the axial center of the rotation shaft 39) and in another case where the photosensitive drum 31 is shifted in a horizontal direction (a X direction) perpendicular to the Y direction. An angle of incidence of the laser light L on the surface of the photosensitive drum 31 is zero (perpendicularly with respect to a tangent line T on the surface of the photosensitive drum 31), and an angle φ of the laser light L with respect to the vertical line V passing through the axial center of the photosensitive drum 31 is about 10 degrees (refer to the left figure in FIG. 13).

As shown in the center figure in FIG. 13, in a case where the photosensitive drum 31 is sifted in the Y direction by a sift distance D, a displacement distance of the writing position of the laser light along the circumferential direction of the photosensitive drum 31 is set to be α. As the angle φ becomes small, the displacement distance α becomes small. On the other hand, as shown in the right figure in FIG. 13, in a case where the photosensitive drum 31 is shifted in the X direction by the same sift distance D, a displacement distance of the writing position of the laser light along the circumferential direction of the photosensitive drum 31 is set to be β. As shown in FIG. 13, the displacement distance β is larger than the displacement distance α. Additionally, the displacement distance becomes large as the shift distance D of the photosensitive drum 31 becomes large.

When the right end portion of the rotation shaft 39 of the photosensitive drum 31 is shifted vertically by the above described adjustment mechanism 30, the photosensitive drum 31 is inclined upward to the right side or downward to the right side. Then, the shift distance D along the vertical direction (the Y direction) is gradually varied along the axial direction of the rotation shaft 39. That is, an amount of the displacement distance (α) of the writing position of the laser light along the circumferential direction of the photosensitive drum 31 is gradually varied along the axial direction of the rotation shaft 39. In detail, as the sift distance D becomes large, the amount of the displacement distance of the writing position becomes large.

As described above, in the color printer 1 of the present disclosure, when the right end portion of the rotation shaft 39 of the photosensitive drum 31 is shifted vertically in the shaft receiving groove 57 by the adjustment mechanism 30, it becomes possible to gradually vary the amount of the displacement distance of the writing position of the laser light along the circumferential direction of the photosensitive drum 31, along the axial direction of the rotation shaft 39. Thereby, it becomes possible to correct the skew (the distortion) of the electrostatic latent image on the photosensitive drum 31. Additionally, the skew can be corrected not on the side of the exposure device 19 but on the side of the photosensitive drum 31 so that a complicated work, such as a fine adjustment of the optical component of the exposure device, can be eliminated.

Specifically, by rotating the adjustment plate 65 using the dial gear 67, the right end portion of the rotation shaft 39 of the photosensitive drum 31 is allowed to be shifted vertically. Accordingly, it becomes possible to correct the skew using the simple structure and by the simple work. Additionally, because the rotation of the dial gear 67 is prevented by the lock mechanism 115 to prevent the rotation of the adjustment plate 65, it becomes possible to prevent the accidental shifting of the right end portion of the rotation shaft 39.

Additionally, when the dial gear 67 is rotated until the click feeling is felt, either one of the arc-shaped edges 77, 78 and 79 comes into contact with the rotation shaft 39. Accordingly, the rotation degree of the dial gear 67 is easily checked to improve its workability.

Like the exposure device 19 of the present embodiment, in a case where the laser light is incident from the approximately lower side along the vertical direction (the Y direction), the amount of the displacement distance of the writing position responds to the shift of the rotation shaft 39 in the X direction more sensitively than in the Y direction. In other words, a ratio (an adjustment sensitivity) of the amount of the displacement distance of the writing position to the amount of the shift distance of the rotation shaft 39 is smaller in the Y direction than in the X direction. Conventionally, the low adjustment sensitively makes a fine adjustment easy. On the contrary, when the skew is remarkably large and it is required to shift the photosensitive drum 31 largely, the high adjustment sensitivity is preferable.

In a case of the angle φ of 45 degrees, the amount of the displacement distance of the writing position is equal between when the rotation shaft 39 is shifted in the X direction and when the rotation shaft 39 is shifted in the Y direction. In a case of the angle φ of 0 degree, the writing position is not displaced even if the rotation shaft 39 is shifted in the Y direction. Accordingly, the angle φ is set to be larger than 0 degree and 45 degrees or smaller. As described, because it becomes possible to set the angle φ within a wide range, a degree of freedom for the arrangement of the exposure device 19 and the image forming unit 17 can be obtained.

Additionally, after the rotation shaft 39 is positioned by any one of the arc-shaped edges of the adjustment part 73 of the adjustment plate 65 and the side edge 57*a* of the shaft receiving groove 57, even if the adjustment plate 65 is slightly rotated, because the rotation shaft 39 is pressed on the same arc-shaped edge, the position of the rotation shaft 39 in the vertical direction is not varied. Accordingly, the photosensitive drum 31 is prevented from being shifted. A number of the arc-shaped edge is not limited to three; may be two or four or more.

Figure 14:
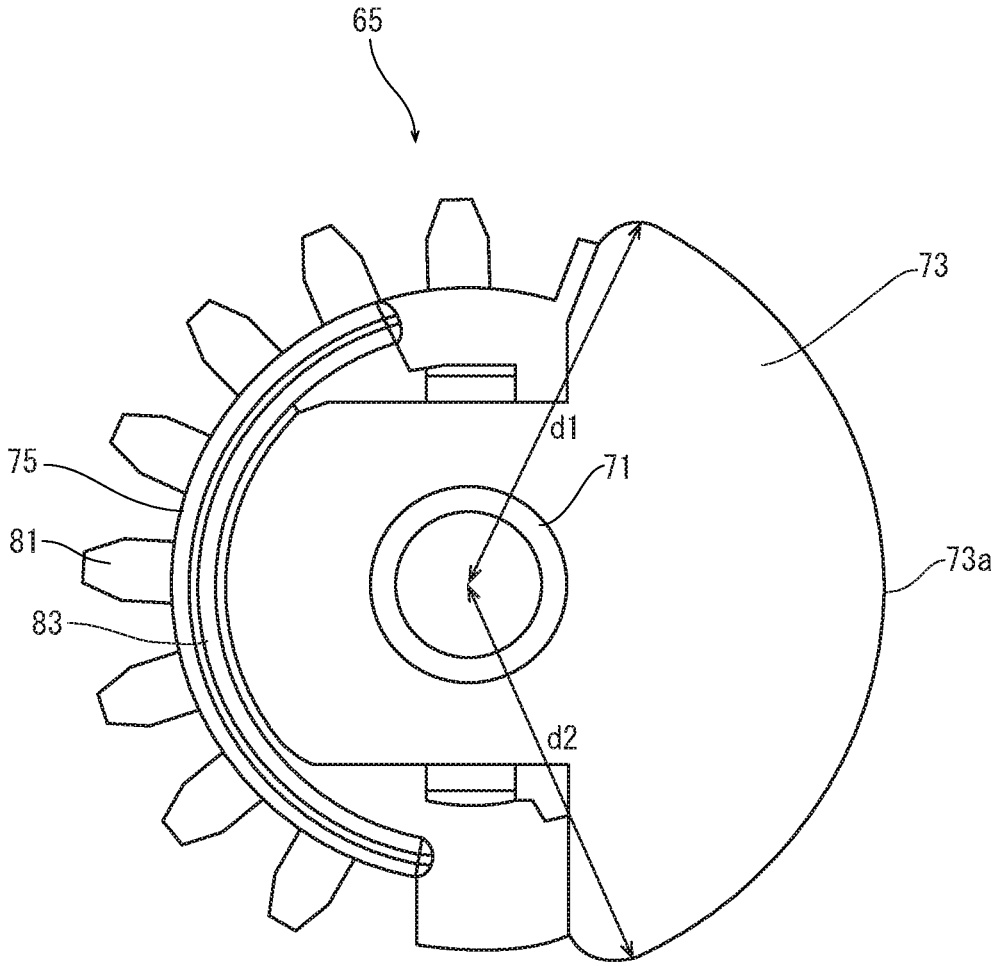
FIG. 14 is a front view showing another example of the adjustment plate, in the color printer according to the embodiment of the present disclosure.

Next, with reference to FIG. 14, another embodiment of the adjustment plate 65 will be described. FIG. 14 is a front view showing the adjustment plate.

In the adjustment plate 65 of the embodiment, the outer circumferential edge 73*a* of the adjustment part 73 is formed such that the radius becomes larger gradually along the circumferential direction. For example, a difference between the minimum radius and the maximum radius is 0.2 mm.

Because the radius of the outer circumferential edge 73*a* of the adjustment part 73 becomes larger along the circumferential direction, it becomes possible to continuously vary the position where the rotation shaft 39 is pressed on the side edge 57*a* of the shaft receiving groove 57.

In the above embodiments, because the rotation shaft 39 is biased downward by the spring 43, it becomes possible to press the rotation shaft 39 to the side edge 57*a* of the shaft receiving groove 57 and the outer circumferential edge 73*a* of the adjustment part 73 of the adjustment part 65 surely. Accordingly, it becomes possible to prevent the rotation shaft 39 from being shifted in the upper- and lower direction and the front-and-rear direction.

Additionally, the dial gear 67 can be viewed through the side opening 61 of the right side plate 29*d* and rotate by the finger inserted through the side opening 61. This improves the workability.

In the present embodiment, all of the drum units 23 are provided with the adjustment mechanisms 30. However, the adjustment mechanism 30 may be provided to only the drum unit 23 corresponding to the yellow toner. That is, by correcting the skew generated on the yellow toner drum unit 23 attached to the farthest position from the black toner drum unit, it becomes possible to correct the skew effectively. In the present embodiment, the right end portion of the rotation shaft 39 can be shifted by the adjustment mechanism 30; however, the left end portion of the rotation shaft 39 may be shifted. Alternatively, the both end portions of the rotation shaft 39 may be shifted.

In the present embodiment, the adjustment plate 65 is rotated by using the rotatable dial gear 7; however, the adjustment plate 65 may be rotated by using a rack member reciprocating along a linear line, in place of the dial gear 67. Alternatively, the adjustment plate 65 may be rotated directly, or by using a stepping motor.

In addition, if the dial gear 67 has a scale showing the rotation degree, the adjustment work can be easily performed.

The lock mechanism 115 is configured such that the dial gear 67 has the plurality of recesses 105 while the second inner plate 29*f* having the protrusion 29*i* engageable with the recess 105; however, the second inner plate 29*f* has the plurality of recesses while the dial gear 67 having the protrusion. Additionally, the recess or the protrusion may be formed in the right side plate 29*d*, and the dial gear 67 may be biased by the spring 111 toward the right side plate 29*d*.

While the above description has been described with reference to the particular illustrative embodiments of the image forming apparatus according to the present disclosure, a technical range of the disclosure is not to be restricted by the description and illustration of the embodiment.

The invention claimed is:

1. An image forming apparatus comprising:

a groove in which a rotation shaft of a photosensitive drum is inserted;

an exposure device configured to emit a laser light on the photosensitive drum to form an electrostatic latent image; and an adjustment member configured to shift the rotation shaft vertically in the groove to adjust a skew of the laser light, wherein the groove has a vertical side edge, the adjustment member is rotatable and has an arc-shaped circumferential edge configured to come into contact with the rotation shaft inserted in the groove from an oblique lower direction and to press the rotation shaft on the side edge, the circumferential edge is configured such that a radius is varied along a circumferential direction, and when the adjustment member is rotated, a contact position of the circumferential edge with the side edge is varied and then a position where the rotation shaft is pressed on the side edge is shifted vertically.

2. The image forming apparatus according to claim 1, wherein the circumferential edge includes a plurality of arc-shaped edges each having a different radius.

3. The image forming apparatus according to claim 1, wherein the circumferential edge is formed such that a radius is gradually varied along a rotation direction of the adjustment member.

4. The image forming apparatus according to claim 1, further comprising a biasing member configured to bias the rotation shaft inserted in the groove downward.

5. The image forming apparatus according to claim 1, further comprising:

a rotatable dial configured to be engaged with the adjustment member and to rotate the adjustment member; and a lock mechanism configured to prevent a rotation of the dial.

6. The image forming apparatus according to claim 5, wherein the lock mechanism includes:

a plurality of recesses provided in the dial at equal center angles;

a protrusion provided in a supporting member by which the dial is supported, the protrusion being configured to be engaged with one of the plurality of recesses in a rotation axis direction of the dial; and a spring configured to bias the dial along the rotation axis direction and to make one of the plurality of recesses engage with the protrusion, wherein when the dial is rotated, the dial is biased by the spring and then one of the plurality of recesses is engaged with the protrusion to restrict the dial from being rotated and to generate a click feeling.

7. The image forming apparatus according to claim 6, wherein the circumferential edge has arc-shaped edges arranged in a rotation direction of the adjustment member, the arc-shaped edges each having a different radius and having an equal center angle, and the dial and the adjustment member each having a gear part, the gear part of the dial and the gear part of the adjustment member being engageable with each other, wherein when a number of teeth of the gear part of the dial is set to Z1, a number of teeth of the gear part of the adjustment member is set to Z2, an angle between centers of the adjacently arranged arc-shaped edges is set to γ1, and an angle between centers of the adjacently arranged recesses is set to γ2, the following relationship is satisfied, $$\gamma 1=\gamma 2\times Z2/Z1.$$

8. The image forming apparatus according to claim 5, comprising an opening formed near the groove, wherein the dial is configured to be operated through the opening.

9. The image forming apparatus according to claim 1, comprising units each including the photosensitive drum, wherein the units correspond to colors including a black color and are arranged in parallel, wherein the adjustment member is provided in at least the unit arranged at the farthest position from the unit corresponding to the black color.

10. The image forming apparatus according to claim 1, wherein in the exposure device, an angle of incidence of the laser light with a vertical line passing through a rotational center of the photosensitive drum is set within a range from 0 degree to 45 degrees.

* * * * *